United States Patent [19]

Large

[11] 4,251,960

[45] Feb. 24, 1981

[54] BLIND CURTAIN ROD HARDWARE

[76] Inventor: Helen F. Large, 25 A Center St., Rumson, N.J. 07760

[21] Appl. No.: 943,190

[22] Filed: Sep. 18, 1978

[51] Int. Cl.[3] ..... A47L 3/00

[52] U.S. Cl. ..... 52/37; 248/215; 248/223.3; 248/254; 248/262

[58] Field of Search ..... 52/27, 37, 36, 702; 16/96 D, 94 D; 248/214, 215, 222.3, 254, 262

[56] References Cited

U.S. PATENT DOCUMENTS

| | | | |
|---|---|---|---|
| 178,247 | 6/1876 | Linscott | 248/215 |
| 1,230,813 | 6/1917 | Sly | 248/254 |
| 1,354,974 | 10/1920 | Hunter | 248/254 |
| 1,570,747 | 1/1926 | Jewett | 248/254 |
| 2,064,984 | 12/1936 | Marsh | 52/702 |
| 2,261,437 | 11/1941 | Galbraith | 52/702 |
| 2,460,193 | 1/1949 | Raudenkolb | 248/214 |
| 2,955,794 | 10/1960 | Robbins | 248/215 |

FOREIGN PATENT DOCUMENTS

| | | | |
|---|---|---|---|
| 9664 | of 1909 | United Kingdom | 248/215 |

*Primary Examiner*—Price C. Faw, Jr.
*Assistant Examiner*—H. E. Raduazo
*Attorney, Agent, or Firm*—LeBlanc, Nolan, Shur & Nies

[57] ABSTRACT

Mounting hardware for curtains, drapery or the like including hidden support pockets mounted in recesses formed in the rear corners of conventional window molding and conventional curtain rods having specially formed mounting brackets inserted into the pockets. Alternatively, curtain rods having depending leg segments inserted into the pockets may be used.

3 Claims, 5 Drawing Figures

BLIND CURTAIN ROD HARDWARE

BACKGROUND OF THE INVENTION

This invention relates to drapery hardware and more particularly to drapery or curtain rod bracket supports and a drapery or curtain rod associated therewith.

Conventional drapery hardware includes a pair of brackets which are attached to a window molding or frame by means of nails or screws and a rod suspended from the pair of brackets.

Attaching such brackets can be difficult. Consequently, the results may be very unsatisfactory, particularly when the operation is attempted by the non-mechanically inclined segment of the general public. Often the wood molding splits as the bracket nails or screws are driven into the molding. The bracket may easily be mounted crookedly or at an angle; thus the rod will be difficult if not impossible to mount on the skewed brackets. When it is desired to change the hardware, the chances of splitting the wood molding become quite high. Often, the same holes in the wood molding must be used for the new hardware, leaving the new brackets insecurely fastened to the molding. If the decision is made to remove the drapes or curtains and not to replace them with new ones, then the unsightly brackets and rod or at least the brackets must be left in place. Or, the brackets could be removed, thus leaving equally unsightly holes where the screws or nails for the brackets had been.

The prior art includes several attempts to overcome these problems. A sampling of that art is disclosed in the following five prior U.S. Patents. The use of a pair of pocket shaped brackets with a curtain rod having mating fittings snap-locked into the pocket shaped brackets is disclosed in U.S. Pat. No. 1,564,747 issued to E. J. Barrett. However, these brackets are permanently mounted so as to be plainly visible when curtains are not hung from the rod. Bracket structure associated with the upper corners of window moldings are disclosed in U.S. Pat. No's. 1,438,490 to C. P. Henry et al; 2,341,039 to G. W. Hartman; and 2,770,437 to E. F. Pasch. In each case, the brackets mounting the curtain rods are plainly visible on the face of the window molding.

A related attempt to overcome the problem of attaching unsightly curtain rod brackets to window moldings is disclosed in U.S. Pat. No. 3,614,045 issued to R. J. Cegielski, Jr. wherein a pair of elongate vertical rails are attached to the wall along the vertical sides of the window molding. The rails are slotted to receive matable curtain rod brackets at selected positions along the rails. Unfortunately, the unsightly brackets are only replaced by equally unsightly rails.

What the prior art above discussed fails to disclose is a curtain rod and bracket structure wherein pockets for mounting the rod are completely hidden from view, whether in use or not, behind the upper opposed corners of conventional window molding surrounding a window.

SUMMARY OF THE INVENTION

Accordingly, it is the principal object of the invention to provide a novel curtain or drapery rod and bracket structure wherein rod mounting pockets are always completely hidden from view, being permanently installed within recesses formed in the rear upper opposed corners of a conventional window frame surrounding a window.

It is another object of the invention to provide a novel curtain rod arrangement with rod mounting pockets wherein there is no need ever to replace the pockets and where the rod may be easily replaced at will with a different style of rod or removed altogether.

It is a further object of the invention to provide a rod mounting bracket arrangement for conventional curtain rods including a pair of hidden pockets and a pair of brackets easily inserted into the pockets and having forward projections for snugly fitting a conventional curtain rod thereon.

It is yet another object of the invention to provide a novel curtain rod and rod mounting arrangement wherein rod mounting pockets may be installed in window molding during initial construction of the house or building or later by the home or building owner.

The curtain or drapery rod and rod mounting assembly of this invention includes a pair of box-shaped pockets which are adapted for installation in mating recesses formed in the upper opposite corners of conventional window frames. A pair of brackets for mounting a conventional rod are inserted into the pockets, or a unique curtain or drapery rod may be provided, having vertically depending end legs which are snugly inserted into the pockets.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which.

DESCRIPTION OF THE PREFERRED EMBODIMENTS

Figure 1:
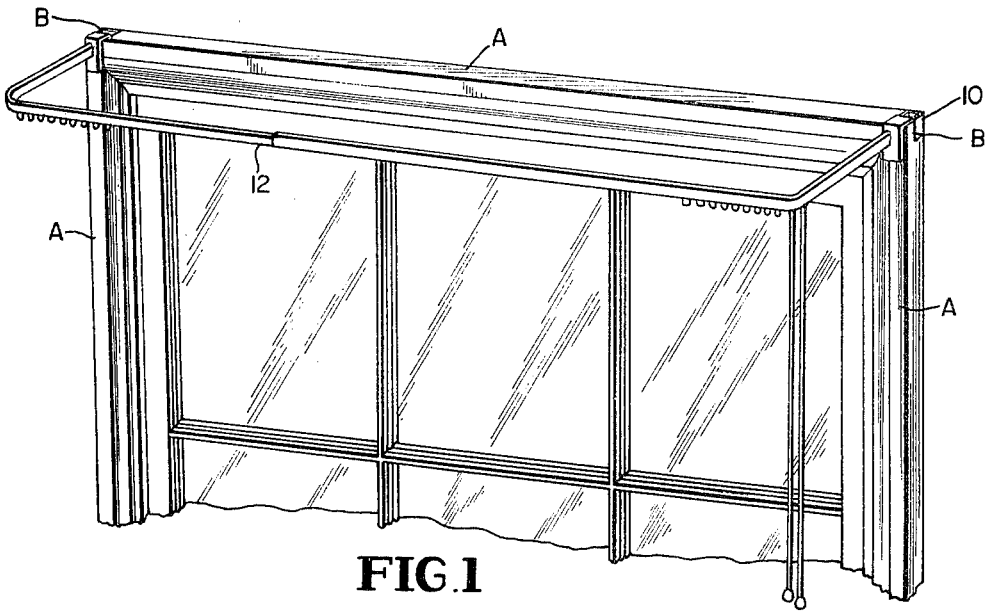
FIG. 1 is a partial perspective view of a conventional window, molding and curtain rod with a preferred embodiment of invention installed for mounting the rod.

A conventional window structure of wood or the like is shown in FIG. 1, including a surrounding frame, the decorative front face of which is designated at A. A pair of recesses B (FIGS. 1 and 2) are formed in the upper opposed end corners of the frame rearwardly behind decorative face A. Recesses B preferably are open at the top, side and rear of the frame. Each recess B is dimensioned to matingly receive a rigid hollow bracket in the form of an upwardly open box-like receptacle or pocket 10 which is fixedly installed wholly within recess B by suitable means, such as an adhesive. As shown in the drawings, each bracket 10 may be integrally formed from sheet metal although other materials such as plastic or an aluminum casting could be used. In addition, the window frame might be made of other material such as a plastic or sheet steel and the recess formed therein. In any event, in a preferred embodiment of the invention, it is contemplated that pockets 10 be fixedly installed within a window frame during initial construction of the building, as a permanent part of the window structure.

However, the pockets 10 could be installed after construction as above described by forming recess B by chiseling or routing, in the case of wood. In all cases the size and shape of the upwardly open pocket 10 conforms to that of the recess B, and when installed the pocket is entirely within the recess and hidden from direct frontal view.

Figure 2:
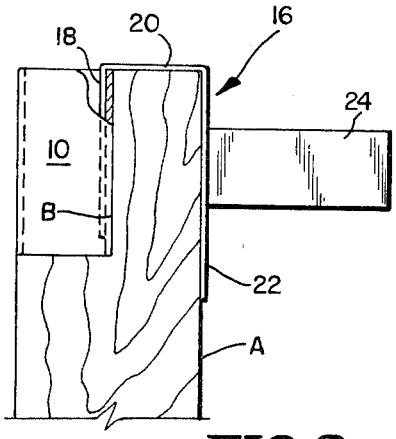
FIG. 2 is a detail view showing one of the rod support pockets and brackets.
Figure 3:
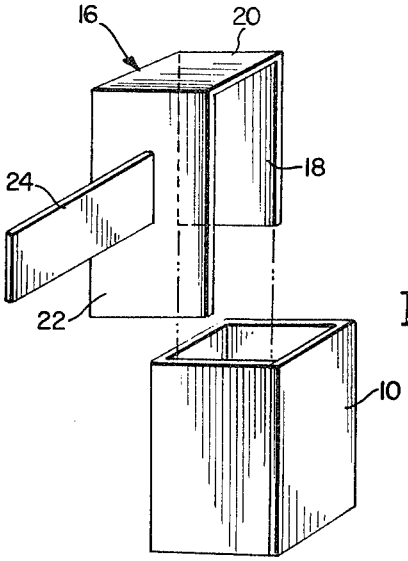
FIG. 3 is a perspective view of one set of the rod mounting pockets and brackets for mounting a conventional rod.
Figure 4:
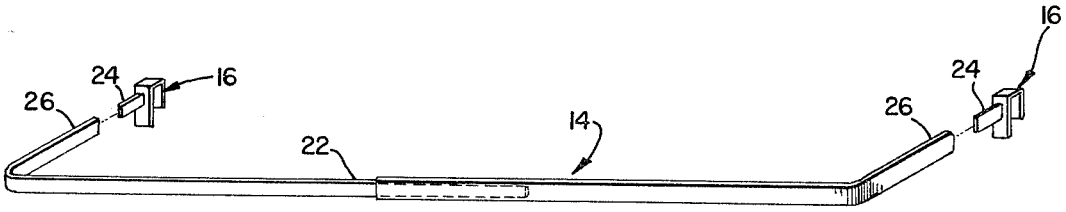
FIG. 4 is a perspective view of an embodiment of a rod structure.

In the preferred embodiment of the invention, a conventional drapery or traverse rod 12 (FIG. 1) or curtain rod 14 (FIG. 4) is used. A pair of unique brackets 16 are provided for mounting the conventional rod 12 or 14, each bracket 16 including a rear depending tab 18 snugly inserted into pocket 10, a bridge 20 overlying the top of the molding between front A and recess B, a forward, dependent face element 22 arranged to lie flush against the window molding as shown in FIG. 2, and a male member 24 onto which female end 26 of rod 12 or rod 14 is fitted.

Installation of traverse rod 12 or curtain rod 14 is relatively uncomplicated. The brackets 16, 16 are easily inserted into their respective pockets 10, 10 whereupon the rod 12 or 14 is installed by slipping ends 26, 26 of rod 12 or 14 onto respective members 24, 24 of brackets 16. Of course, each of the members 24 and ends 26 are relatively dimensioned for friction fit engagement of each end 26 with its member 24. It should be noted that member 24 is positioned on face 22 at a location coinciding with the usual position of convention drapery or curtain rod brackets on face A of the window frame. Thus, when conventional bracket structure is replaced with the hardware of this invention, the length of the drapes or curtains being hung will not have to be altered since the curtain or drapery rod will be reinstalled in the same place and at the same height from the floor as initially installed.

Figure 5:
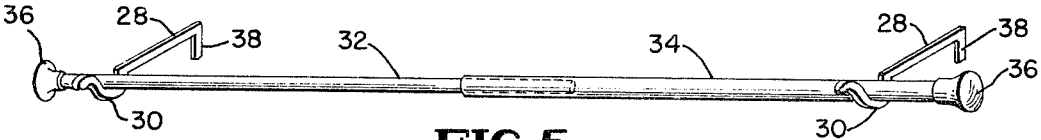
FIG. 5 is a perspective view of another embodiment of a rod structure.

Another embodiment of a rod is shown in FIG. 5 wherein rod end portions 28 have cradles 30 formed in their outer ends. A telescoping rod assembly having relatively slidable segments 32, 34 is laid upon cradles 30, 30, respectively, and a pair of decorative end caps 36, 36 may be slipped over the ends of the segments 32, 34. Each rod end portion 28 includes a vertically depending base leg 38, dimensioned to snugly interfit with a pocket 10. Accordingly, there is no need for brackets 16 in this embodiment of the invention.

When it is decided not to hang curtains or drapes from the window, the rod may be easily removed along with brackets 16 (if used) without leaving behind any visible, unsightly bracket structure, since pockets 10, 10 are completely hidden from view and continue to fill the recesses B. Pockets 10 are preferably flush with adjacent window frame surfaces. Unlike conventional curtain rod brackets which are attached by screws or nails and thus usually weaken after a period of time, pockets 10 of the present invention are permanently mounted (whether installed at the time of building construction or later) and do not weaken in support over a period of time. Thus, a firm permanent and reliable curtain rod and supporting bracket assembly is provided which is easily assembled and disassembled (after installation of the pockets) particularly by senior citizens and by the less mechanically inclined members of the public. Additionally, the rod may be very easily and safely installed and removed and changed for a different style of drapery or curtain rod—that shown in FIG. 5 for the style shown in FIG. 4, for example.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Mounting hardware for curtains, drapery of the like and adapted for installation in association with windows having surrounding window frame means comprising: means defining a pair of preformed, upwardly open recesses entirely within the respective, rear upper corners of the window frame means; means in the form of at least a pair of upwardly open receptacles, each receptacle being provided at an upper corner of the window frame means, substantially entirely within a respective one of said recesses formed within the rear part of the window frame means, whereby when curtains or drapes are not hung about the window no aesthetically unpleasant drapery hardware or the like is visible; curtain or drapery rod support means including means interfitted within and readily detachable from said receptacles comprising a generally inverted U-shaped bracket with a rear leg thereof inserted in one of said receptacles, a forward, depending leg thereof arranged to lay over a corner of a window frame means; attachment means no said forward leg for engaging a curtain or drapery rod end therewith comprising a male member projecting outwardly from said forward leg; and a curtain or drapery rod having female ends engageable with the male members of said attachment means.

2. The mounting hardware for curtains, drapery or the like as claimed in claim 1 wherein each said receptacle comprises a rectangular box or pocket, said box being formed from sheet metal and further comprising securing means for permanently installing said pocket.

3. The mounting hardware for curtains, drapery or the like as claimed in claim 1 wherein said curtain or drapery rod support means comprise a pair of rod support end members, each having a said means interfitted within said receptacles, comprising a depending end leg shaped to be snugly interfitted with a corresponding one of said receptacles.

* * * * *